US007144295B2

(12) United States Patent
Fisher

(10) Patent No.: US 7,144,295 B2
(45) **Date of Patent: *Dec. 5, 2006**

(54) ANTI-WRINKLE BREAST SUPPORT PAD

(75) Inventor: Kelly Fisher, El Paso, TX (US)

(73) Assignee: Kelly J. Fisher, El Paso, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/002,362

(22) Filed: Dec. 2, 2004

(65) Prior Publication Data

US 2006/0121825 A1 Jun. 8, 2006

(51) Int. Cl.
*A41C 3/12* (2006.01)
*A41C 3/14* (2006.01)

(52) U.S. Cl. ..... 450/54; 450/57; 2/267

(58) Field of Classification Search ..... 450/54.57, 450/89, 36, 37, 31, 32, 39; 2/267, 268, 73, 2/78.1–78.4, 104–106, 69, 114, 463, 92; 602/60, 61; 128/845, 846, 848, 873–876, 128/889–891

See application file for complete search history.

(56) References Cited

U.S. PATENT DOCUMENTS

| | | | | |
|---|---|---|---|---|
| 3,257,666 | A * | 6/1966 | Hoffman | 2/459 |
| 5,716,255 | A * | 2/1998 | Abercrombie et al. | 450/60 |
| 5,807,160 | A * | 9/1998 | Wehmeyer | 450/57 |
| 6,168,498 | B1 * | 1/2001 | Wagner | 450/58 |
| 6,439,958 | B1 * | 8/2002 | Lorenzo | 450/1 |
| 6,769,955 | B1 * | 8/2004 | Fisher | 450/54 |

* cited by examiner

*Primary Examiner*—Gloria M. Hale
(74) *Attorney, Agent, or Firm*—Donald W. Meeker

(57) ABSTRACT

A breast support pad for supporting the upper breast when the wearer of a brassiere is lying on one side, the breast support pad placeable generally inside and against the central portion of the brassiere between the two curved portions and away from the other portions of the brassiere, the breast support pad comprising a body having a front face with a thick vertical section and a back face adapted to conform with the chest of the wearer between the breasts, the back face comprising a concave cavity on each side of a centrally located vertical surface, each concave cavity adapted to conform to and support either breast when the wearer lies on one side.

8 Claims, 4 Drawing Sheets

ANTI-WRINKLE BREAST SUPPORT PAD

BACKGROUND OF THE INVENTION

The disclosed invention is directed to devices which aid in the prevention of wrinkles on the skin in the chest area between a woman's breasts which are caused to appear over time when a woman sleeps or lies on her side with breasts unsupported. More specifically, the disclosed invention is directed to a breast support pad designed to be used in combination with a brassiere worn by the user when lying on her side.

No known prior art is directed to a breast support pad device designed to be used in combination with a brassiere during sleep to prevent the formation of wrinkles on the skin in the chest area between the breasts of the wearer. The applicant incorporates by reference the discussion of prior art in the Background of the Invention Section of the specification of U.S. Pat. No. 6,769,955 to Fisher.

SUMMARY OF THE INVENTION

The patent applicant incorporates by reference in its entirety the specification of U.S. Pat. No. 6,769,955 issued to Fisher on Aug. 3, 2004.

The object of the disclosed invention is to provide a device which the wearer may use in combination with any one of a number of conventional types of brassieres to be worn during sleep or when the wearer is lying down, which device aids in the prevention of the formation of wrinkles on the skin of the chest area of the wearer between the breasts.

The object of the disclosed invention is to provide a simple and inexpensive method to aid in the prevention of the formation of wrinkles on the skin of the chest area of a woman between the breasts which result over time when the upper breast droops over the lower breast when a woman sleeps or lies on her side.

The breast support pad per the disclosed invention comprises a body that has on its front face a smooth vertical section with a thick midsection, and on its back face a concave curved cavity on each side of a centrally located smooth vertical surface which conforms to the chest structure between the breasts of a woman. Each concave curved cavity of the breast support pad is adapted for supporting either breast of the wearer while the wearer lies on one side. The disclosed breast support pad may be manufactured using any soft, comfortable, body-conforming material such as but not limited to dense foam, molded material, or any similar material known or to be discovered. The breast support pad may be sized as appropriate to accommodate different body shapes and sizes of the wearer. As an example and not by way of limitation, the breast support pad may be made to be thin and long, thick and long, thick and short, depending upon the body structure and size of the woman in the chest area. Additionally, the breast support pad may be placed inside a removable and washable casing made of soft, absorbent fabric so to absorb sweat of the wearer during sleep.

The disclosed center breast support pad may also be worn by the user in combination with a brassiere during the time that the wearer is not lying down. The reason for this is that the center breast support pad provides added comfort and support for each breast and this may be beneficial to the wearer who needs the added support during certain activities such as exercise and whose outer clothing adequately conceals the bulk of the center breast support pad placed inside the brassiere.

In use, the center breast support pad may be tucked inside the brassiere in the part of the brassiere that is the section located between the two breast cups. Thus, in one embodiment, no securement means for the center breast support pad is required because the section of the brassiere between the two breast cups is adequate by itself to support the center breast support pad and keep it in place between the breasts while the user sleeps or lies on her side while wearing the brassiere. Examples of uses where a separate securement means is not required for the center breast support pad are the so-called comfort bras and exercise bras which typically have wide sections of strong, stretchable fabric between the two breast cups of the brassiere for added support.

Per another embodiment which does not require a separate securement means for the center breast support pad, the brassiere has a zipper section which is located between the two breasts cups. The user unzips the zipper section, places the breast support pad therein with its back surface in contact with the chest, and zips the zipper section to secure the breast support pad and hold it in place.

In another embodiment, securement of the center breast support pad to the inside of the brassiere is accomplished with the aid of strips of adhesive or strips of VELCR® hoop and loop fastener.

In another embodiment, the brassiere has a centrally located retainer means which is a fabric pocket and the user places the breast support pad inside the pocket to secure the breast support pad in place while the user sleeps on her side while wearing the brassiere.

DESCRIPTION OF THE DRAWINGS

Figure 1:
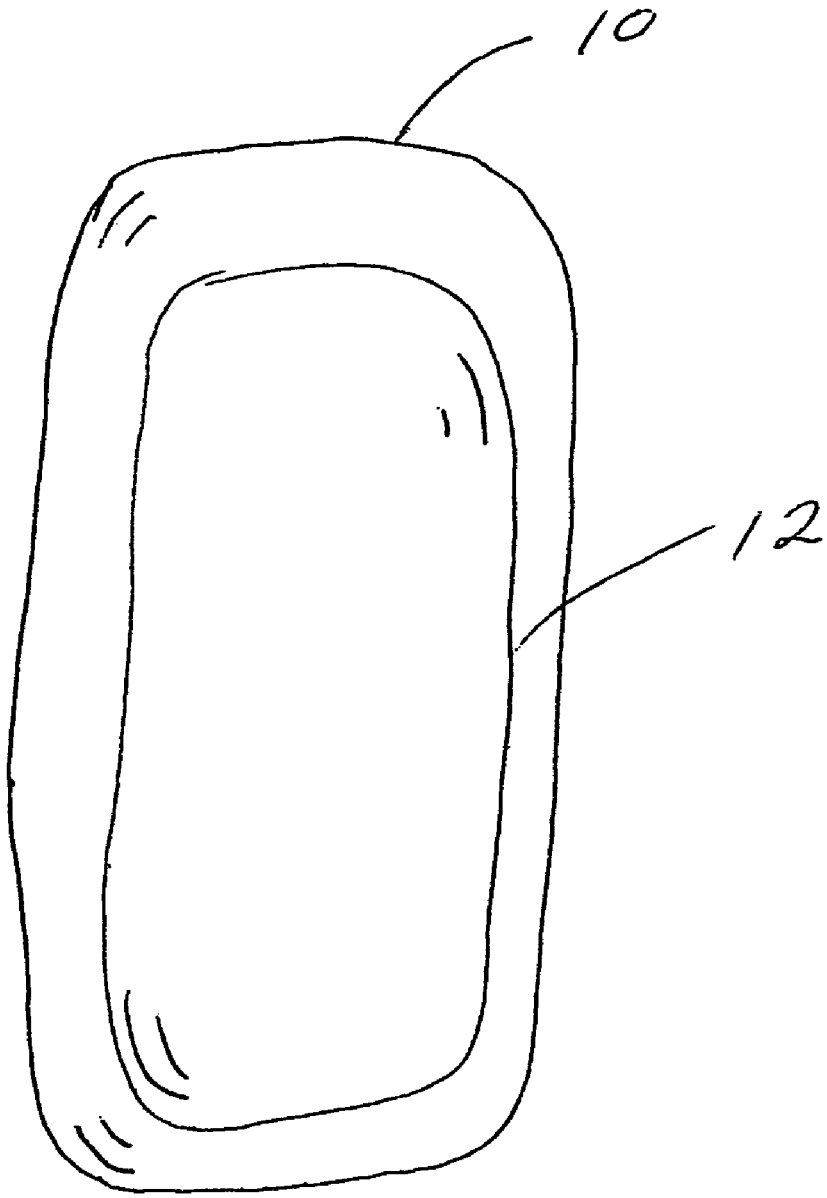
FIG. 1 is a front perspective of the front surface of the breast support pad per the preferred embodiment of the disclosed invention.

FIG. 1 is a front perspective of the breast support pad 10 per the preferred embodiment of the disclosed invention showing the smooth front vertical surface 11 of the breast support pad 10 with its thick midsection 12. The front surface of the breast support pad is the surface which is opposite the surface of the breast support pad which comes in contact with the skin of the chest of the wearer of a brassiere used in combination with the breast support pad.

Figure 2:
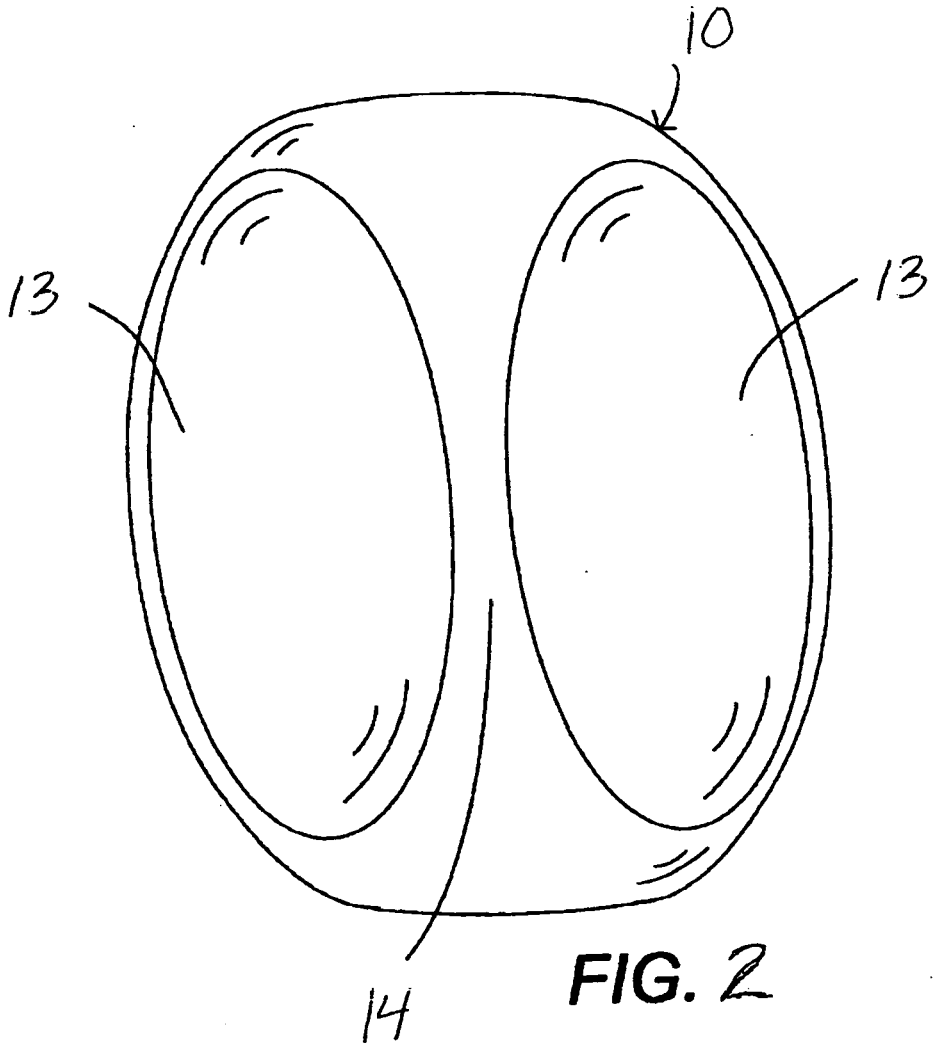
FIG. 2 is a front perspective of the back surfaces of the breast support pad per the preferred embodiment of the disclosed invention.

FIG. 2 is a front perspective of the breast support pad 10 per the preferred embodiment showing the back surfaces of the breast support pad, which comprise two vertical concave cavities 13 and a centrally located smooth vertical section 14 between the two concave cavities 13. The back surfaces of the breast support pad are the surfaces which come in contact with the skin of the chest and breasts of the user.

Figure 3:
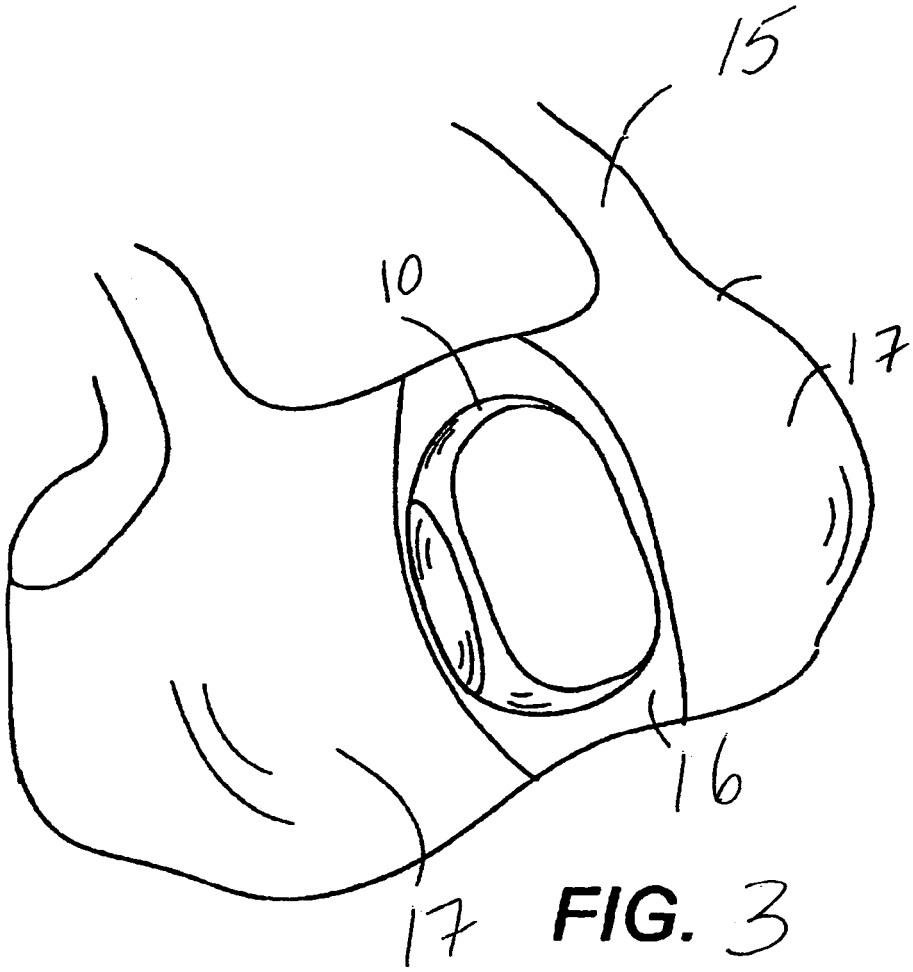
FIG. 3 is a front perspective showing the proper placement of the breast support pad inside a conventional brassiere.

FIG. 3 shows the proper placement of the breast support pad inside a brassiere 15 and against the inside surface of that part 16 of the brassiere which is between the two breast-supporting cups 17.

Figure 4:
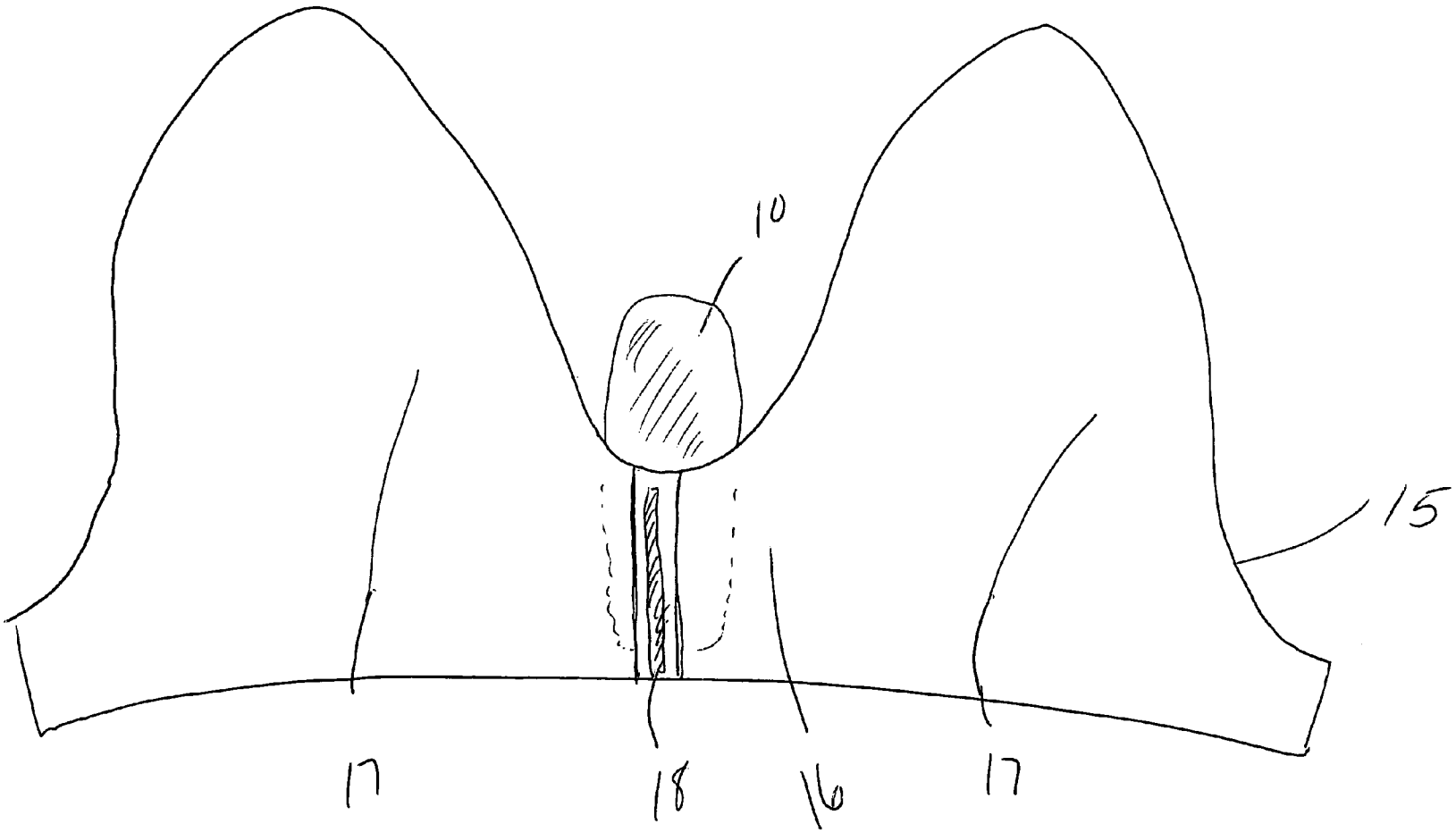
FIG. 4 is a front perspective showing the proper placement of the breast support pad in a brassiere which has a zipper section located in the central portion of the brassiere between the two breast-supporting cups.

FIG. 4 shows an embodiment of the disclosed invention whereby the breast support pad 10 is used in combination with a brassiere 15 which has a zipper section 18 located in the central portion of the brassiere between the two breast-supporting cups 17. The zipper section 18 helps secure the breast support pad 10 inside and against the central portion 16 of the brassiere between the two breast-supporting cups 17.

I claim:

1. A breast support pad to said in the prevention of wrinkles on the skin in a chest area between a woman's breasts which wrinkles are caused to appear over time when a woman sleeps on her side with breasts unsupported and an upper breast droops over a lower breast, the breast support pad comprising:

a breast support pad insertable between the breasts of a user, the breast support pad comprising a firm body that has on its front face a smooth vertical section with a thick midsection, and on its back face a concave curved cavity on each side of a centrally located smooth vertical surface which vertical section conforms to the chest structure between the breasts of a woman, each concave curved cavity conforming to a breast of a user with the breast support pad positioned against the chest of the user between the breasts of the user, so that when the user of the breast support pad is lying on one side and one breast is in an upper position and the other breast lies thereunder in a lower position, the breast pad supports the upper breast of the user with the upper breast supported by an upper concave curved cavity to prevent the upper breast from drooping down over the lower breast to prevent wrinkling of the skin on the chest of the user in the chest area between the breasts of the user; and a securement means to aid in keeping the breast support pad between the breasts of the wearer in use.

2. The breast support pad of claim 1 wherein the breast support pad is formed of a soft dense foam material.

3. The breast support pad of claim 1 wherein the breast support pad is made of a soft molded material.

4. The breast support pad of claim 1 further comprising a removable soft absorbent fabric casing for housing the breast support pad.

5. The breast support pad of claim 1 wherein the securement means comprises a brassiere worn by the user between.

6. The breast support pad of claim 1 wherein the securement means comprises a pocket attached to an inside of a central portion of a brassiere worn by the user.

7. The breast support pad of claim 1 wherein said securement means comprises a zipper section located at a center front portion of a brassiere worn by the user.

8. A method to said in the prevention of wrinkles on the skin in a chest area between a woman's breasts which wrinkles are caused to appear over time when a woman sleeps on her side with breasts unsupported and an upper breast droops over a lower breast, the method comprising the steps of;

inserting a breast support pad between the breasts of a user, the breast support pad comprising a firm body that has on its face a smooth vertical section with a thick midsection, and on its back face a concave curved cavity on each side of a centrally located smooth vertical surface which conforms to the chest structure between the breasts of a woman, each concave curved cavity conforming to a breast of a user with the breast support pad positioned against the chest of the user between the breasts of the user, so that when the user of the breast support pad is lying on one side and one breast is in an upper position and the other breast lies thereunder in a lower position, the breast pad supports the upper breast of the user with the upper breast supported by an upper concave curved cavity to prevent the upper breast from drooping down over the lower breast to prevent wrinkling of the skin on the chest of the user in the chest area between the breasts of the user; and securing the breast support pad between the breasts of the user by a securement means to aid in keeping the breast support pad between the breasts of the user.

* * * * *